US008417162B2

(12) United States Patent
Matsuo

(10) Patent No.: US 8,417,162 B2
(45) Date of Patent: Apr. 9, 2013

(54) IMAGE FORMING APPARATUS FOR SETTING A VELOCITY DIFFERENCE BETWEEN A PHOTOSENSITIVE DRUM AND AN INTERMEDIATE TRANSFER BELT

(75) Inventor: Takamichi Matsuo, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 303 days.

(21) Appl. No.: 12/717,841

(22) Filed: Mar. 4, 2010

(65) Prior Publication Data

US 2010/0226677 A1 Sep. 9, 2010

(30) Foreign Application Priority Data

Mar. 9, 2009 (JP) ..... 2009-054858

(51) Int. Cl.
*G03G 15/00* (2006.01)

(52) U.S. Cl. ..... 399/301

(58) Field of Classification Search ..... 399/301
See application file for complete search history.

(56) References Cited

U.S. PATENT DOCUMENTS

| | | | | |
|---|---|---|---|---|
| 5,313,252 | A * | 5/1994 | Castelli et al. | 399/49 |
| 2004/0109708 | A1* | 6/2004 | Kobayashi et al. | 399/301 |
| 2009/0214241 | A1* | 8/2009 | Kawaguchi et al. | 399/66 |
| 2011/0052275 | A1* | 3/2011 | Matsumoto | 399/301 |

FOREIGN PATENT DOCUMENTS

| | | | |
|---|---|---|---|
| JP | 2003-228217 | A | 8/2003 |
| JP | 2008170747 | A * | 7/2008 |

* cited by examiner

*Primary Examiner* — Quana M Grainger
(74) *Attorney, Agent, or Firm* — Canon USA Inc. IP Division

(57) ABSTRACT

An image forming apparatus detects a plurality of times by changing velocity of a photosensitive drum, color misregistration generated when a developing roller separates from a photosensitive drum and calculates a relation between the velocity of the photosensitive drum and the color misregistration. A velocity of the photosensitive drum is changed and an arbitrary peripheral velocity difference is set between the photosensitive drum and the intermediate transfer belt based on the calculated result.

8 Claims, 15 Drawing Sheets

IMAGE FORMING APPARATUS FOR SETTING A VELOCITY DIFFERENCE BETWEEN A PHOTOSENSITIVE DRUM AND AN INTERMEDIATE TRANSFER BELT

BACKGROUND OF THE INVENTION

1. Field of the Invention

The present invention relates to drive control of an image forming apparatus which forms an image on a recording medium.

2. Description of the Related Art

Color misregistration is one of the criteria for determining output image quality of a color image forming apparatus in which high-quality image output is demanded. To reduce such color misregistration, the image forming apparatus may form toner patches of each color on an intermediate transfer belt and detect color misregistration using a registration detection sensor to detect the position of the toner patches. The color image forming apparatus then changes timing of forming each color image on a photosensitive drum based on the detection result.

Further, velocity fluctuation of the intermediate transfer belt causes color misregistration in an image forming apparatus which sequentially activates image forming units including the photosensitive drum. If velocity fluctuation is generated in a transfer conveyance belt or the intermediate transfer belt, power applied on the belt from an image bearing member becomes different at respective transfer nips of the image forming units for each color. As a result, a pulling force or a pressing force is applied on the belt between the transfer nips of the image forming units of each color, which causes a difference in the velocities of the belt passing through each of the transfer nips. Color misregistration is thus generated. When peripheral velocities of the photosensitive drum and the intermediate transfer belt are different, a friction coefficient between the photosensitive drum and the intermediate drum changes according to the presence or absence of toner in a primary transfer nip portion. Such change in the friction coefficient also causes a change in a tangential force, thus leading to generation of color misregistration.

To solve such a problem, there is a technique for preventing velocity fluctuation of the intermediate transfer belt from affecting the image. More specifically, load fluctuation is generated when charging, developing, and transferring processes are switched on and off in the image forming unit. In such a technique, the processes are switched on and off when a visualized image is not being transferred from the photosensitive drum to the intermediate transfer member.

However, in the above-described method, time for performing the charging and developing processes becomes longer, so that the lifetime of the image forming unit becomes immoderately shortened.

Further, it has been determined by inventors that a relation between the peripheral velocity difference of the photosensitive drum and the intermediate transfer belt, and the color misregistration caused by the velocity fluctuation of the intermediate transfer belt changes due to other factors. An example of such factors is usage of the photosensitive drum and the intermediate transfer belt. It is thus necessary to consider the factors which affect the degree of change in the tangential force to reduce color misregistration.

SUMMARY OF THE INVENTION

The present invention is directed to reducing color registration without immoderately shortening the life of the image forming unit and by flexibly suppressing velocity fluctuation of the intermediate transfer belt generated while forming an image.

According to an aspect of the present invention, an image forming apparatus includes an image forming unit comprising a plurality of image bearing members, a plurality of developing units capable of coming into contact with and separating from each of the plurality of image bearing members, an intermediate transfer member onto which toner images developed on the plurality of image bearing members by the plurality of developing units are transferred, and a transfer member which forms a nip portion with the image bearing member by sandwiching the intermediate transfer member. The image forming apparatus further includes a pattern forming unit configured to form on the intermediate transfer member by employing the image forming unit a pattern for detecting misregistration including a first color mark formed in a stable state in which toner enters all of the nip portions of the plurality of image bearing members, and a second color mark formed in a fluctuating state in which toner enters a part of the nip portions of the plurality of image bearing members, a detection unit configured to detect positions of the first color mark and the second color mark included in the pattern for detecting misregistration, and a correction unit configured to correct a relative velocity between the image bearing member and the intermediate transfer member based on a detection result of the detection unit. The pattern forming unit forms a first pattern and a second pattern as the patterns with respect to a plurality of the relative velocities, and the correction unit corrects the relative velocity based on a position of the first color mark and a position of the second color mark included in the first pattern and a position of the first color mark and a position of the second color mark included in the second pattern, detected by the detection unit.

According to the present invention, color registration can be reduced without immoderately shortening the life of the image forming unit and by flexibly suppressing velocity fluctuation of the intermediate transfer member generated while forming an image.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

The individual embodiments described below will be helpful in understanding a variety of concepts of the present invention from the generic to the more specific. Further, the technical scope of the present invention is defined by the claims, and is not limited by the following individual embodiments.

Various exemplary embodiments, features, and aspects of the invention will be described in detail below with reference to the drawings.

Figure 1:
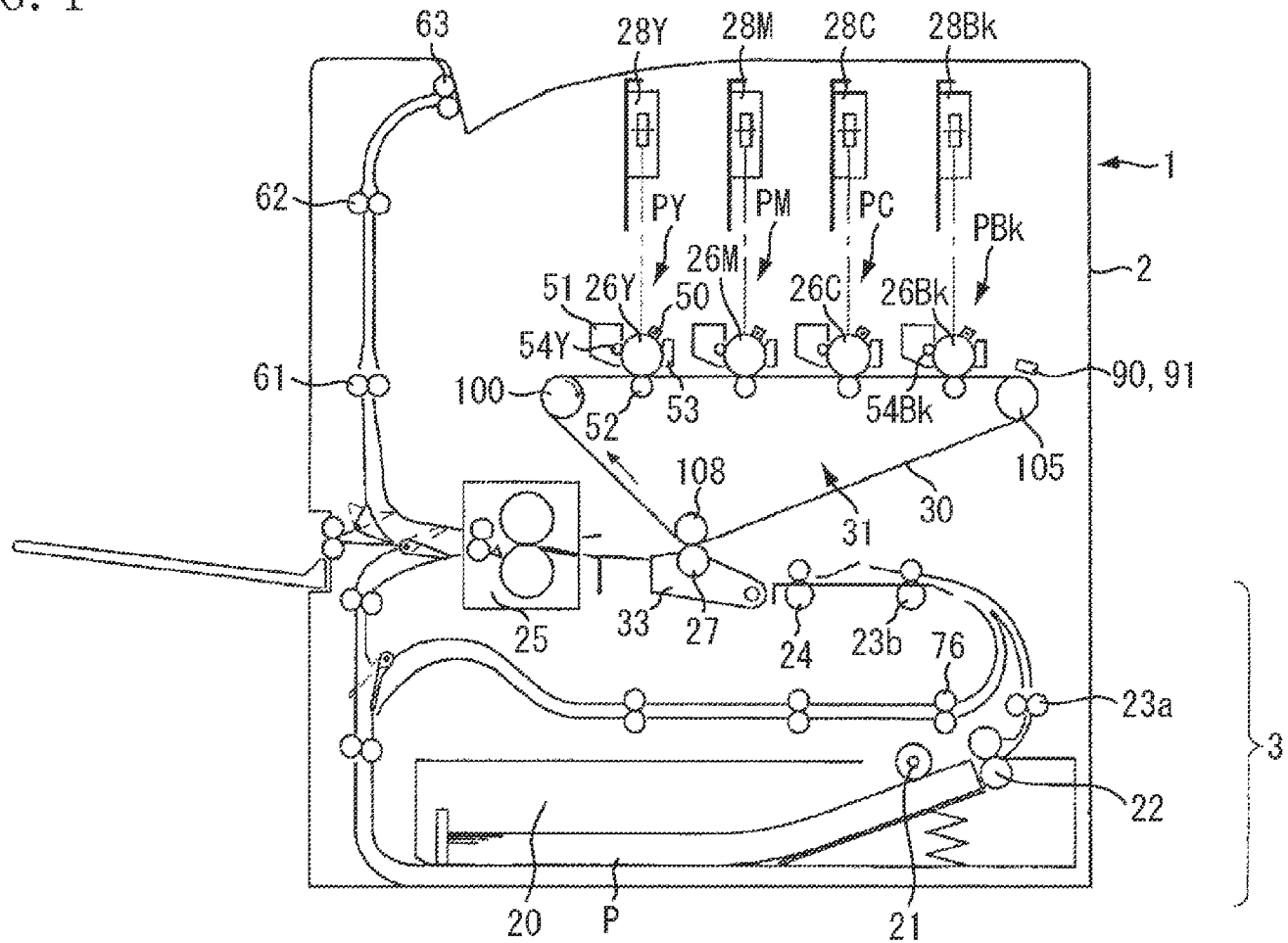
FIG. 1 is a cross-sectional view of a full-color image forming apparatus according to an exemplary embodiment of the present invention.

FIG. 1 is a schematic diagram illustrating a configuration of a four-drum full-color image forming apparatus employing an intermediate transfer belt, among image forming apparatuses according to an exemplary embodiment of the present invention.

Referring to FIG. 1, a four-drum full-color image forming apparatus 1 includes a four-drum full-color image forming apparatus main body 2 (hereinafter referred to as an apparatus main body 2). The apparatus main body 2 includes process cartridges PY, PM, PC, and Pbk for each of four respective colors, i.e., yellow, magenta, cyan, and black. The apparatus main body 2 further includes an intermediate transfer belt unit 31 comprising an intermediate transfer belt 30, and a fixing unit 25.

Each of the process cartridges is located on an outer circumferential surface of respective photosensitive drums 26Y, 26M, 26C, and 26Bk (i.e., on the image bearing member). Each process cartridge includes a primary charging unit 50 which uniformly charges a surface of each of the photosensitive drum 26. Further, the process cartridge includes a developing unit 51 which develops an electrostatic latent image on the surface of the photosensitive drum 26 formed by laser exposure from laser exposure units 28Y, 28M, 28C, and 28Bk. The process cartridges are arranged in parallel along the intermediate transfer belt 30.

A developing roller 54 inside the developing unit 51 causes the entire developing unit 51 to separate from the photosensitive drum 26 and thus stop rotating to prevent deterioration of developer. Further, a primary transfer roller 52 is disposed opposite to the photosensitive drum 26 to sandwich the intermediate transfer belt 30 with the photosensitive drum 26. The primary transfer roller 52 forms a primary transfer portion with the photosensitive drum 26. Furthermore, the photosensitive drums 26Y, 26M, 26C, and 26Bk are driven by a drum driving motor (not illustrated). The drum driving motor can be individually installed for each photosensitive drum or can be shared by a plurality of photosensitive drums. Moreover, the present exemplary embodiment can also be applied to a photosensitive belt instead of the photosensitive drum as described above.

The intermediate transfer belt unit 31 includes the intermediate transfer belt 30, and a drive roller 100, a tension roller, and a secondary transfer counter roller 108 around which the intermediate transfer belt 30 is stretched. A belt drive motor 14 (not illustrated) rotationally drives the drive roller 100, and the intermediate transfer belt 30 is thus rotationally conveyed. The tension roller 105 can move in a horizontal direction shown in FIG. 1 according to a length of the intermediate transfer belt 30.

Further, there are two registration detection sensors 90 near the tension roller 105 at both ends in a longitudinal direction of the tension roller 105. The registration detection sensors 90 which detect the toner patches on the intermediate transfer belt 30 are disposed opposite to the image bearing member, and each detection sensor includes a light emitting unit and a light receiving unit. The light emitting unit of the registration detection sensor 90 irradiates with light the toner image formed on the image bearing member or the image bearing member itself, and the light receiving unit receives the reflected light. For example, the registration detection sensor 90 irradiates a color misregistration detection pattern (to be described below) with light and receives the reflected light. In such a case, the registration detection sensor 90 detects the position of the color misregistration detection pattern or mark by a change in reflection of the image bearing member and the color misregistration detection pattern.

A secondary transfer roller 27 included in a transfer conveying unit 33 is disposed to sandwich the intermediate transfer belt 30 with a secondary transfer counter roller 108. A sheet feeding unit 3 feeds a transfer material to a secondary transfer portion configured of a contact portion between the secondary transfer roller 27 and the secondary transfer counter roller 108. The sheet feeding unit 3 includes a cassette 20 containing a plurality of transfer materials, a feed roller 21, a retard roller pair 22 which prevents double feed, conveyance roller pairs 23*a* and 23*b*, and a registration roller pair 24. Discharge roller pairs 61, 62, and 63 are disposed downstream of a conveyance path from the fixing unit 25.

The belt drive motor 14 is a drive unit for rotationally driving the intermediate transfer belt 30 at a predetermined velocity by instruction form an image forming control unit. Further, the drum drive motor is a drive unit for rotationally driving all photosensitive drums 26 at a predetermined velocity by instruction from the image forming control unit.

Figure 2:
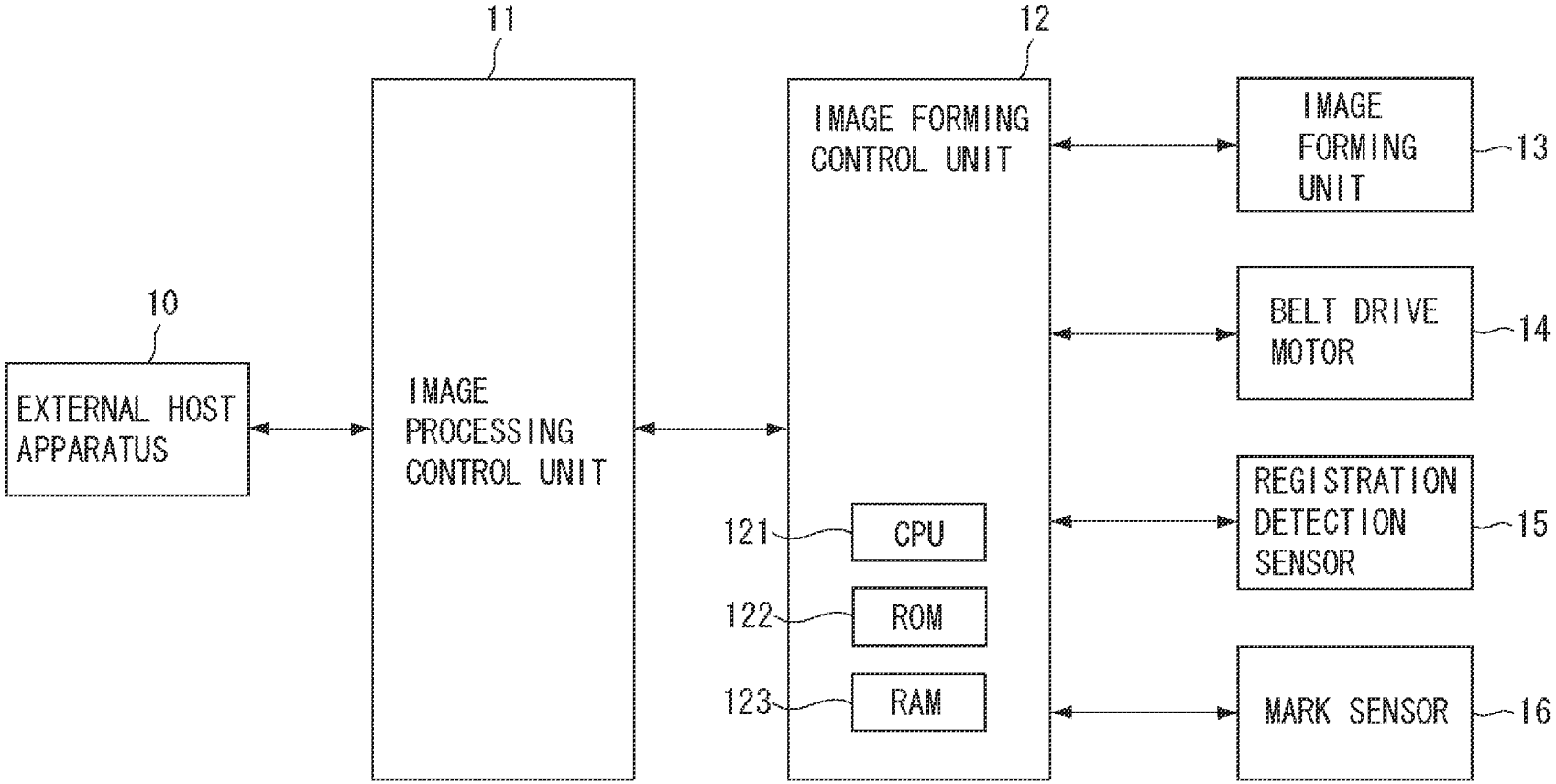
FIG. 2 is a block diagram illustrating a configuration of an image forming apparatus according to an exemplary embodiment of the present invention.

FIG. 2 is a block diagram illustrating a control configuration of the image forming apparatus according to an exemplary embodiment of the present invention.

Referring to FIG. 2, the apparatus main body 2 illustrated in FIG. 1 receives an image signal (RGB signal or page description language data) from an external host apparatus 10 such as a personal computer which is communicably connected thereto. The apparatus main body 2 may also receive the image signal from a document reading unit (not illustrated) separately included therein. An image processing control unit 11 converts the received image signal to a CMYK signal, performs gradation and concentration correction on the converted CMYK signal, and generates an exposure signal to be used by the laser exposure unit 28.

An image forming control unit 12 comprehensively controls the image forming operation described below. The image forming control unit 12 also controls the apparatus main body 2 when correcting the image forming operation by using the registration detection sensors 90 and a mark sensor 91. The image forming control unit 12 includes a central processing unit (CPU) 121, a read-only memory (ROM) 122 which stores programs to be executed by the CPU 121, and a random access memory (RAM) 123 which store various data when the CPU 121 performs control.

An image forming unit 13 includes the photosensitive drum 26 illustrated in FIG. 1, and a charging unit, a developing unit, a cleaning unit, and an exposure unit which act on the photosensitive drum 26. One image forming unit 13 or a plurality of the image forming units 13 is disposed in the rotational direction of the intermediate transfer belt 30.

The belt drive motor 14 is the drive unit which adjusts a conveying velocity of the intermediate transfer belt 30 in response to an instruction from the image forming control unit 12. A registration detection sensor unit 15 uses the registration detection sensors 90 to detect the toner patches on the intermediate transfer belt 30. A mark sensor detection unit 16 uses the mark sensor 91 to detect a position indication mark disposed on the intermediate transfer belt 30.

The image forming operation performed by the above-described four-drum full-color image forming apparatus 1 will be described below with reference to FIG. 1. Upon start of the image forming operation, the sheet feeding roller 21 feeds transfer materials P in the cassette 20. The retard roller pair 22 separates the transfer materials P into each sheet which is then conveyed to the registration roller pair 24 via the conveyance roller pairs 23*a* and 23*b*. In parallel with the conveyance operation of the transfer materials P, the surface of the photosensitive drum 26Y in the yellow process cartridge PY is uniformly charged to a negative polarity by the primary charging unit 50. The laser exposure unit 28Y then exposes the photosensitive drum with image light, so that the electrostatic latent image corresponding to a yellow image component of the image signal is formed on the surface of the photosensitive drum 26Y.

The developing roller 54Y in the developing roller 51 is then rotationally driven to come into contact with the photosensitive drum 26Y. The developing unit 51 develops the electrostatic latent image using the negatively-charged yellow toner, and the electrostatic latent image is thus visualized as a yellow toner image. The developing unit 51 can also come into contact with the photosensitive drum 26 directly before forming the electrostatic latent image. The primary transfer roller 52 on which a primary transfer bias is applied then primarily transfers the acquired yellow toner image onto the intermediate transfer belt 30. A cleaner 53 removes residual toner adhering to the surface of the photosensitive drum 26Y after the toner image is transferred.

Such series of toner image forming operation is also sequentially performed in the other process cartridges PM, PC, and PBk. More specifically, the color toner images formed on each of the respective photosensitive drums 26 are primarily transferred at the primary transfer portion and sequentially superimposed on the intermediate transfer belt 30. Upon completing the developing process, the developing roller 54 separates from the photosensitive drum 26 and stops rotating even when the process cartridge located downstream of the conveyance path is performing primary transfer. This is to prevent deterioration of the developer. The contacting-separating sequence of the developing unit 51 will be described below with reference to FIG. 10.

The four-color toner image superimposed and transferred on the intermediate transfer belt 30 is then shifted to the secondary transfer portion by rotation of the intermediate transfer belt 30 in a direction indicated by an arrow illustrated in FIG. 1. The transfer material P is also conveyed to the secondary transfer portion in time with the image transferred on the intermediate transfer belt 30. The secondary transfer roller 27 then comes into contact with the intermediate transfer belt 30 by sandwiching the transfer material P, and secondarily transfers the four-color toner image on the intermediate transfer belt 30 to the transfer material P. The transfer material P on which the toner image is thus transferred is conveyed to the fixing unit 25 where the toner image is heated and press-fixed on the transfer material P. The discharge roller pairs 61, 62, and 63 then discharge and mount the transfer material P onto the apparatus main body 2.

An intermediate transfer belt cleaning apparatus disposed near the drive roller 100 removes residual toner remaining on the surface of the intermediate transfer belt 30 after performing secondary transfer.

The intermediate transfer belt unit 31 will be described below.

Figure 3A:
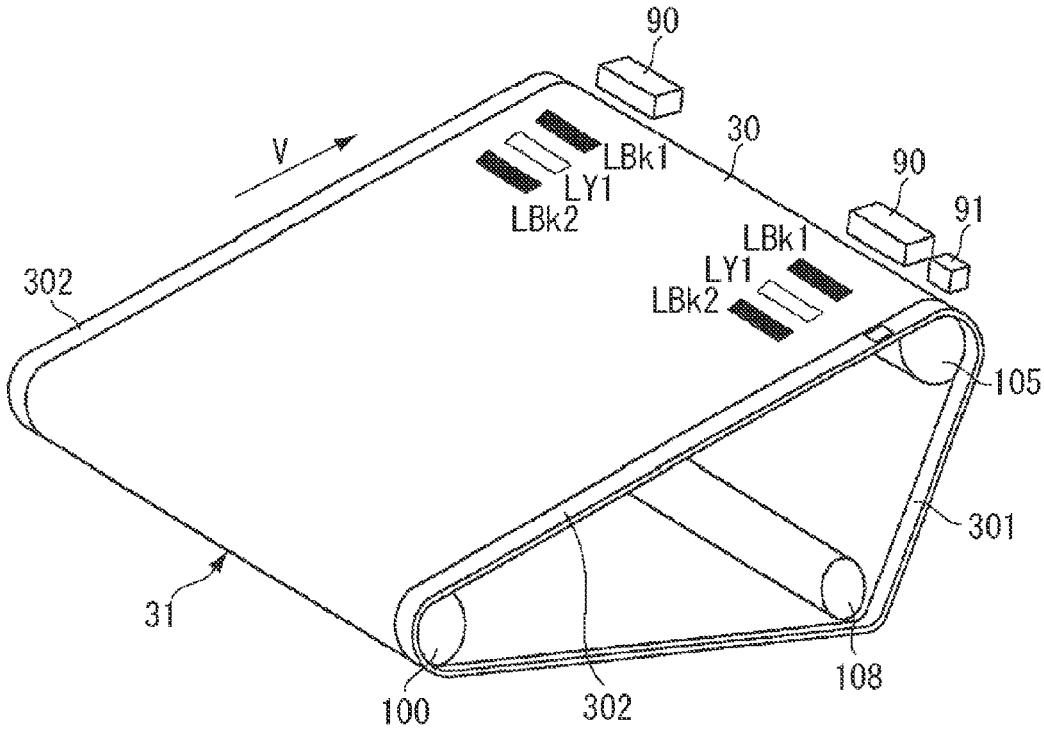
FIGS. 3A, 3B, and 3C illustrate examples of a perspective view of an intermediate transfer belt and a color misregistration detection patterns.

FIG. 3A illustrates a perspective view of a configuration of the intermediate transfer belt unit 31. Referring to FIG. 3A, the intermediate transfer belt 30 is rotating in a direction illustrated by an arrow at a speed V mm/s. A regulating rib 301 is adhered to both side edges of an inner circumferential surface of the intermediate transfer belt 30 according to the present exemplary embodiment. The regulating rib 301 which is regulated by a regulating flange (not illustrated) disposed at both ends of the tension roller 105 prevents the intermediate transfer belt 30 from meandering. Further, a transparent belt reinforcing tape 302 is adhered to both side edges of the outer circumferential surface of the intermediate transfer belt 30 to prevent the intermediate transfer belt 30 from being damaged. The registration detection sensor 90 is a reflective optical sensor for detecting an unfixed toner patch formed on the intermediate transfer belt 30. According to the present exemplary embodiment, the registration detection sensor 90 is disposed on each end of the tension roller 105 in the longitudinal direction.

Color misregistration mechanism will be described below. A drive transmission system which drives the intermediate transfer belt 30 includes a series of gears. Distortion of a gear tooth surface or a sheet metal supporting the drive transmission system, or tipping of a shaft supporting the gear due to a load torque causes a delay in drive transmission. As a result, if the torque on a drive roller shaft driving the intermediate transfer belt 30 fluctuates when the developing roller 54 comes into contact with or separates from the photosensitive drum 26, velocity fluctuation is generated in the intermediate transfer belt 30. The velocity fluctuation is generated when there is load torque fluctuation and a change in a distortion amount of the drive transmission system. The velocity fluctuation is not generated when the distortion amount of the drive transmission system is constant owing to a regular load torque.

If the peripheral velocity of the photosensitive drum 26 is less than the peripheral velocity of the intermediate transfer belt 30, the peripheral velocity of the intermediate transfer belt 30 increases when the developing roller 54 is in contact with the photosensitive drum 26. The peripheral velocity of the intermediate transfer belt 30 remains constant when there is no torque fluctuation and decreases when the developing roller 54 separates from the photosensitive drum 26.

On the contrary, if the peripheral velocity of the photosensitive drum 26 is greater than that of the intermediate transfer belt 30, the peripheral velocity of the intermediate transfer belt 30 decreases when the developing roller 54 comes into contact with the photosensitive drum 26. The peripheral velocity of the intermediate transfer belt 30 increases when the developing roller 54 separates from the photosensitive drum 26.

Causes of the velocity fluctuation of the intermediate transfer belt 30 will be described in detail below.

(i) Velocity Fluctuation Due to Entry of Toner

Figure 4:
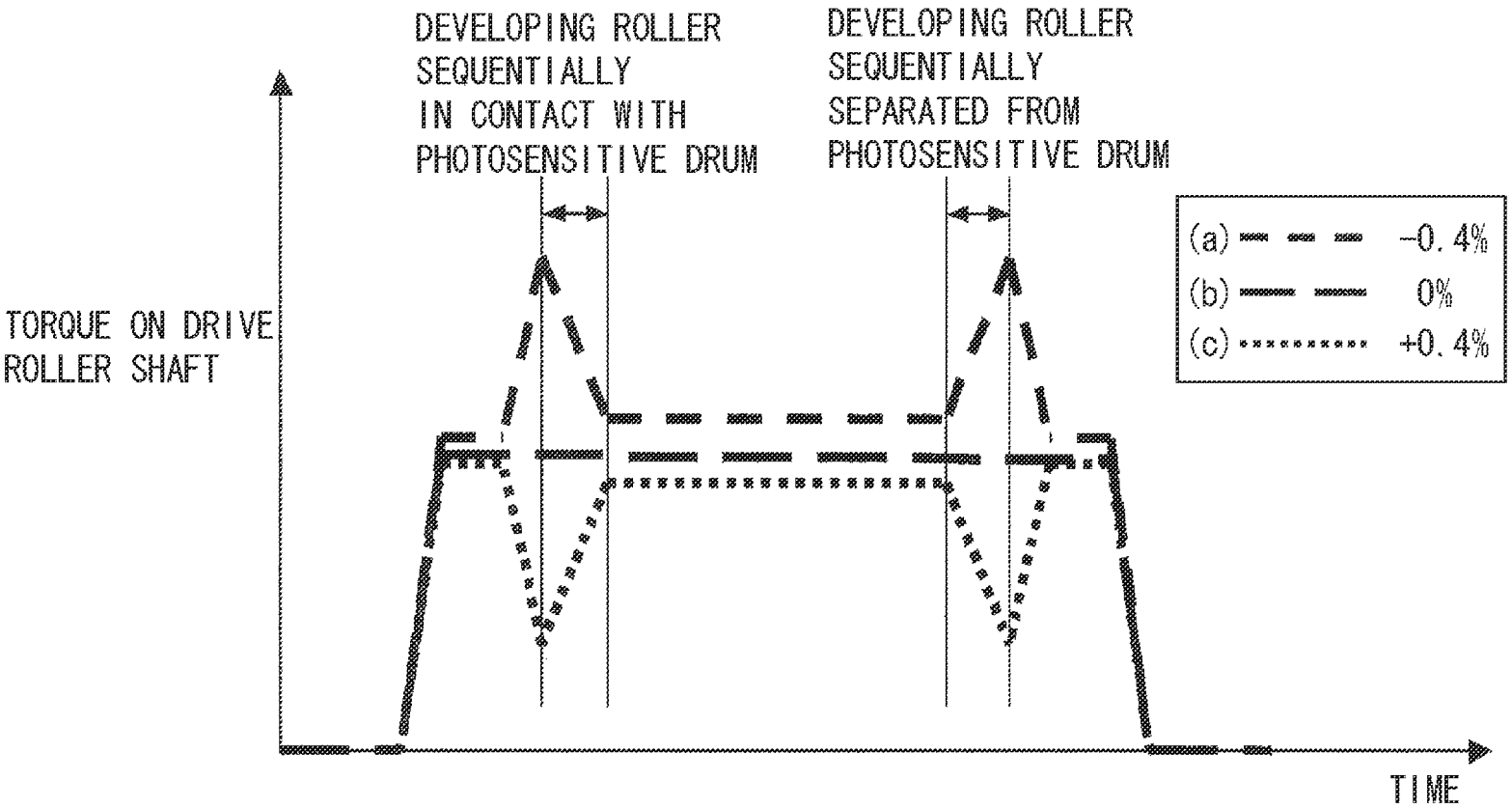
FIG. 4 illustrates an example of fluctuation of torque on a drive roller shaft which drives an intermediate transfer belt while printing, with respect to time.

FIG. 4 illustrates the load torque on the drive roller shaft when making a print in a case where the peripheral velocity difference between the photosensitive drum 26 and the intermediate transfer belt 30 is zero or proximately zero. Further, FIG. 4 illustrates the load torque in a case where the velocity of the photosensitive drum 26 is changed so that the peripheral velocity difference is purposely generated. The "peripheral velocity difference" indicates a difference between the velocity of the photosensitive drum in a tangential line direction and the velocity of the intermediate transfer belt at the primary transfer nip portion.

Referring to FIG. 4, line A indicates the load torque on the drive roller shaft when the peripheral velocity of the photosensitive drum is 0.4% less than the peripheral velocity of the intermediate transfer belt. Line B indicates the load torque when the peripheral velocity of the photosensitive drum and the peripheral velocity of the intermediate transfer belt are the same or proximately the same. Line C indicates the load torque when the peripheral velocity of the photosensitive drum is 0.4% greater than the peripheral velocity of the intermediate transfer belt. The "peripheral velocity of the photosensitive drum" is the velocity of the photosensitive drum surface at the nip portion in the tangential line direction. The "peripheral velocity of the intermediate transfer belt" is the velocity of the intermediate transfer belt at the nip portion in a conveying direction.

According to FIG. 4, transient torque fluctuation is generated when there is a peripheral velocity difference between the photosensitive drum 26 and the intermediate transfer belt 30 while forming an image. The torque fluctuation begins when the developing roller 54 inside the developing unit 51 which is rotationally driven comes into contact with the yellow photosensitive drum 26Y. The developing roller 54 of each color located downstream of the developing roller 54Y then sequentially comes into contact with the respective photosensitive drum 26Y. The torque fluctuation ends after the black developing roller 54Bk comes into contact with the photosensitive drum 26Bk. The torque fluctuation begins again when the primary transfer of the yellow toner image ends and the developing roller 54Y is separated from the photosensitive drum 26Y.

The torque fluctuation generated when the developing roller 54 comes into contact with and is separated from the photosensitive drum 26 is caused by the toner entering the primary transfer nip. The toner of the developing roller 54Y adheres to the photosensitive drum 26Y as fogging toner when the latent image is being formed. The fogging toner then reaches the primary transfer nip portion between the photosensitive drum 26Y and the intermediate transfer belt 30.

Figure 5:
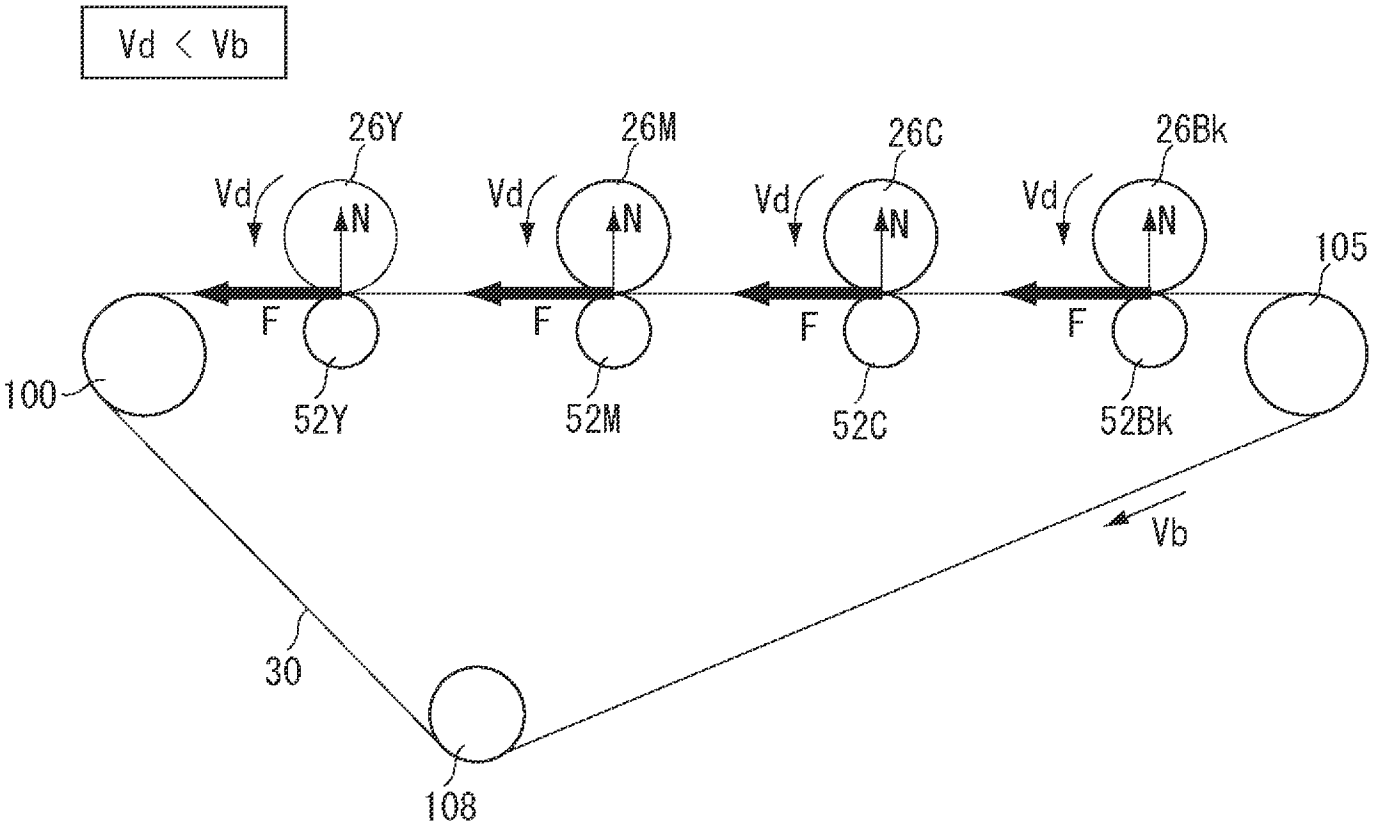
FIG. 5 illustrates tangential forces generated in primary transfer nip portions which act on an intermediate transfer belt.

FIG. 5 illustrates an example of a case where the tangential force acts on the primary transfer nip. The "tangential force" is a force which acts in the direction of the tangential line of the photosensitive drum at the primary transfer nip portion. Referring to FIG. 5, a vertical drag N acts on the primary transfer nip. The vertical drag N is expressed as a sum of a primary transfer pressure Np which is a mechanical pressing force, and an electrostatic attraction force Ne which is an electric attraction force. Further, a tangential force F acting on the primary transfer nip when there is a peripheral velocity difference is expressed by equation (1). μ indicates a friction coefficient between the photosensitive drum 26 and the intermediate transfer belt 30.

$$F=\mu\times(Np+Ne) \tag{1}$$

If there are four photosensitive drums 26 for the four colors, the tangential force F is generated in each primary transfer nip, and a resultant force T of the tangential forces for each color acts on the intermediate transfer belt 30.

Further, if the friction coefficients between the photosensitive drum 26 and the intermediate transfer belt 30 is μ1 when there is no toner in the primary transfer nip and μ2 when there is toner in the primary nip, the relation between μ1 and μ2 is μ1>μ2.

When there is no toner in the primary transfer nip, a resultant force T acting on the intermediate transfer belt 30 is expressed by equation (2). According to equation (2), the load on the intermediate transfer belt 30 is four times the load on the photosensitive drum 26.

$$T=\mu1\times(Np+Ne)\times4 \tag{2}$$

Upon start of the image forming operation, the developing roller 54Y comes into contact with the yellow photosensitive drum 26Y, and the yellow toner enters the yellow primary transfer nip. In such a case, a power T1 acting on the intermediate transfer belt 30 is expressed as equation (3).

$$T1=\mu1\times(Np+Ne)\times3+\mu2\times(Np+Ne) \tag{3}$$

The developing roller 54 of each color then sequentially comes into contact with the respective photosensitive drum 26.

When the toner enters the primary transfer nip, the force acting on the intermediate transfer belt 30 changes as expressed in an order of equation (4), equation (5), and equation (6).

$$T2=\mu1\times(Np+Ne)\times2+\mu2\times(Np+Ne)\times2 \tag{4}$$

$$T3=\mu1\times(Np+Ne)+\mu2\times(Np+Ne)\times3 \tag{5}$$

$$T4=\mu2\times(Np+Ne)\times4 \tag{6}$$

Since the relation between μ1 and μ2 is μ1>μ2, a relation between the forces acting on the intermediate transfer belt 30 becomes T1>T2>T3>T4.

If the peripheral velocity of the photosensitive drum 26 is less than that of the intermediate transfer belt 30, the photosensitive drum 26 acts as a brake with respect to the intermediate transfer belt 30. In such a case, as illustrated in FIG. 4, the torque on the drive roller shaft increases at the start of the image forming operation when the primary transfer roller 52 comes into contact with the photosensitive drum 26 and applies the primary transfer bias.

A force T then acts on the intermediate transfer belt 30. The developing roller 54 of each color then comes into contact with the respective photosensitive drum 26, and the force acting on the intermediate transfer belt 30 changes from T1 to T2 and to T3. The torque on the drive roller shaft thus gradually decreases. The tangential force stops fluctuating further when the toner enters the primary transfer nip where the black toner image is primarily transferred and the force acting on the intermediate transfer belt 30 becomes T4. As a result, the torque on the drive roller shaft stops fluctuating.

When the primary transfer of the yellow toner image is completed and the developing roller 54Y separates from the photosensitive drum 26Y, there is no toner left in primary transfer nip where the yellow toner image is primarily transferred. The force acting on the intermediate transfer belt 30 thus becomes T3. The developing roller 54 of each color then separates from the respective photosensitive drum 26, and the force acting on the intermediate transfer belt 30 changes to T2, T1, and to T and becomes greater. The torque on the drive roller shaft thus increases.

On the contrary, if the peripheral velocity of the photosensitive drum (Vd) is greater than that of the intermediate transfer belt (Vb), the photosensitive drum 26 assists the rotation of the intermediate transfer belt 30. When the developing roller 54 of each color sequentially comes into contact with the respective photosensitive drum 26, a force with which the photosensitive drum 26 assists the rotation of the intermediate transfer belt 30 decreases. The torque of the drive roller shaft thus gradually increases. After the primary transfer ends and the developing roller 54 starts separating from the photosensitive drum 26, the force with which the photosensitive drum 26 assists the rotation of the intermediate transfer belt 30 increases. The torque on the drive roller shaft thus decreases.

Figure 6:
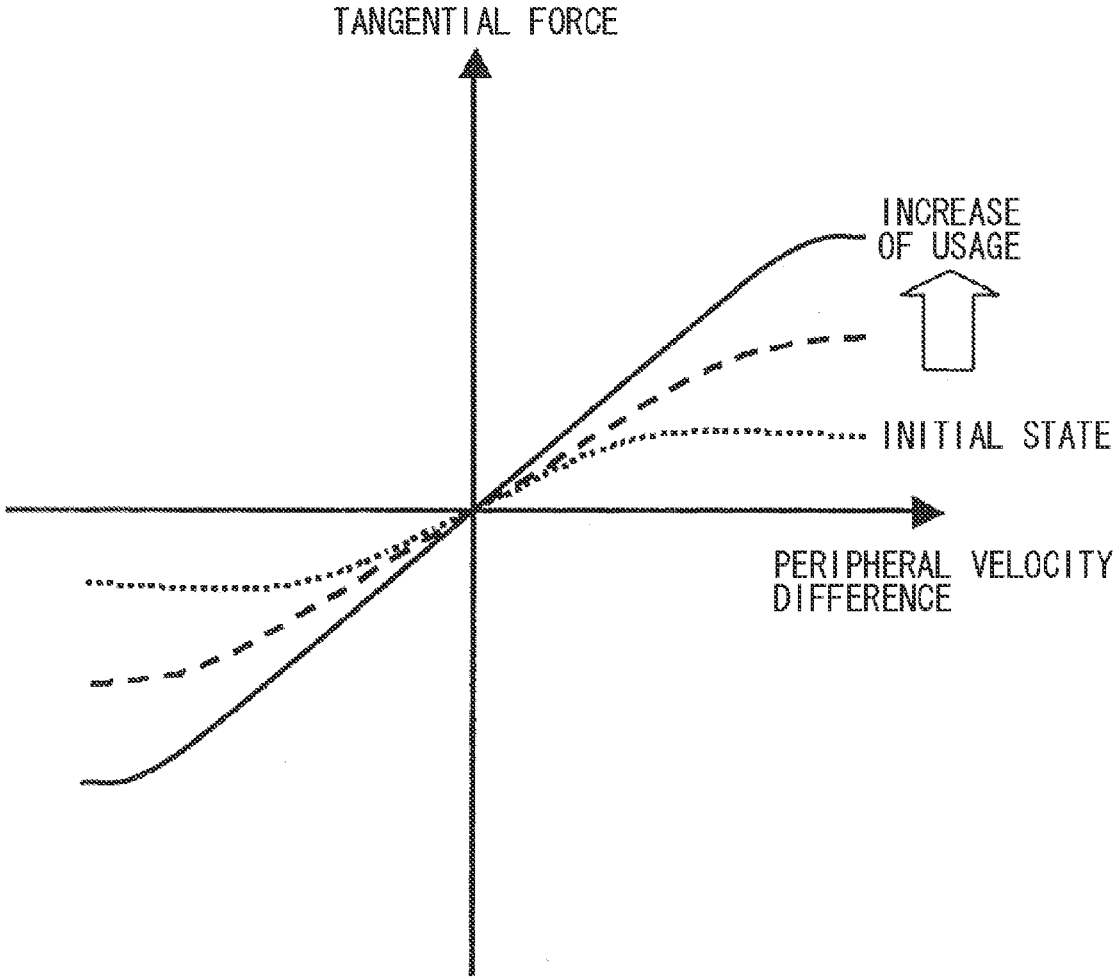
FIG. 6 illustrates an example of a relation between a peripheral velocity difference between a photosensitive drum and an intermediate transfer belt, and tangential force acting on a primary transfer nip.

(ii) Relation Between Velocity Fluctuation and a Size of the Peripheral Velocity Difference FIG. 6 illustrates a relation between the peripheral velocity difference between the photosensitive drum 26 and the intermediate transfer belt 30 and the tangential force acting on the primary transfer nip. If the peripheral velocity difference is small, the tangential force increases along with the peripheral velocity difference. However, since the friction coefficient μ changes according to the size of the peripheral velocity difference, the tangential force becomes constant when the peripheral velocity difference becomes greater.

If the peripheral velocity difference is zero or proximately zero, the photosensitive drum 26 and the intermediate transfer belt 30 are in rolling contact, so that the friction coefficient is zero. However, if the peripheral velocity difference is small, the photosensitive drum 26 and the intermediate transfer belt 30 are in both rolling contact and sliding contact. The friction coefficient thus increases as the peripheral velocity difference increases. When the peripheral velocity difference becomes greater than a predetermined value, the photosensitive drum 26 and the intermediate transfer belt 30 come into sliding contact, and the friction coefficient becomes constant. As a result, the relation between the peripheral velocity difference and the tangential force becomes as illustrated in FIG. 6.

(iii) Velocity Fluctuation and the Degree of Usage

The friction coefficient μ increases as surface roughness of the intermediate transfer belt 30 increases. Flaws generated on the intermediate transfer belt 30 due to usage causes the increase in the surface roughness. As a result, as illustrated in FIG. 6, the tangential force F is greater in a used intermediate transfer belt as compared to a new intermediate transfer belt even when the peripheral velocity differences are the same in both cases. Further, the same can be said for the photosensitive drum 26. The usage status indicates the degree of usage, and an increase in the degree of usage indicates deterioration of the intermediate transfer belt caused by heavy usage.

(iv) Velocity Fluctuation Due to Other Factors

Other examples of factors which cause velocity fluctuation of the intermediate transfer belt 30 are the environment of the image forming apparatus (e.g., temperature and humidity), and outside diameter tolerance (manufacturing error) of the drive roller 100 which is attributable to manufacturing conditions. Further, aged deterioration of the image forming apparatus may cause velocity fluctuation of the intermediate transfer belt 30. The degree of velocity fluctuation due to factors described in (i), (ii) and (iii) changes according to such factors. To address the fluctuation, the image forming apparatus according to the present exemplary embodiment flexibly responds to the various factors and reduces velocity fluctuation of the intermediate transfer member generated during the image forming operation. Color misregistration is thus reduced.

Figure 7A:
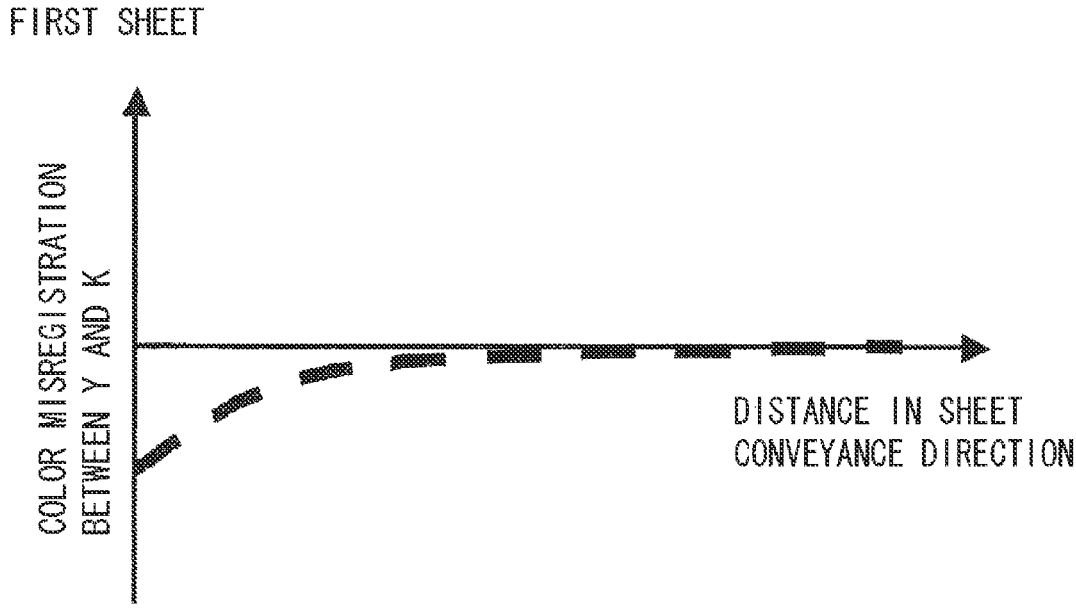
FIGS. 7A, 7B, and 7C illustrate examples of generation of color misregistration of a yellow toner image with respect to a black color image when three letter size sheets are continuously printed.
Figure 7B:
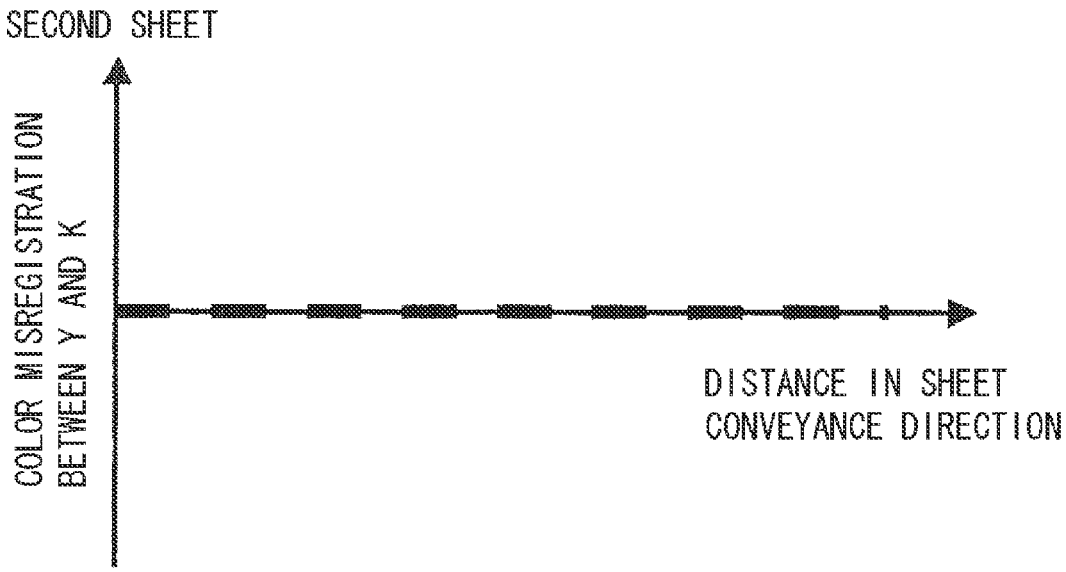
Figure 7C:
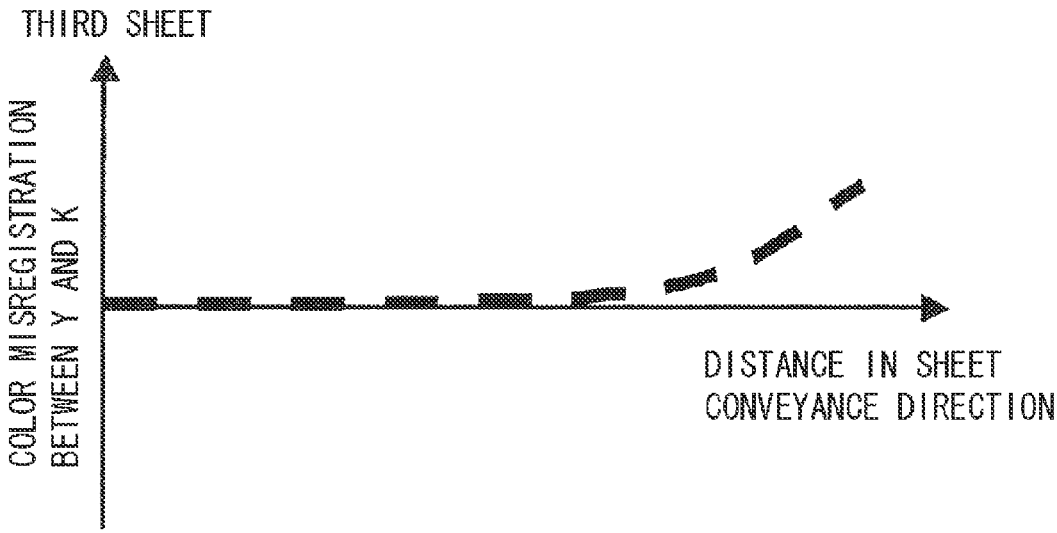

A relation between the velocity fluctuation of the intermediate transfer belt 30 and color misregistration will be described below. FIGS. 7A, 7B, and 7C illustrate misregistration of the yellow toner image with respect to the black toner image when three letter-size sheets are continuously output. In the example, the peripheral velocity of the photosensitive drum is less than the peripheral velocity of the intermediate transfer belt. FIG. 7A illustrates color misregistration in the first sheet, FIG. 7B in the second sheet, and FIG. 7C in the third sheet.

Referring to FIGS. 7A, 7B, and 7C, color misregistration of the yellow toner image against the black toner image in the image generated in a trailing edge of the sheet is indicated in a positive region with respect to a vertical axis. The misregistration of the yellow toner image with respect to the black toner image is considered for the following reason. According to the present exemplary embodiment, the yellow image forming unit is a first station which performs the initial primary transfer, and the black image forming unit is a fourth station which performs the final primary transfer. The difference between the torques on the drive roller when performing primary transfer is thus greatest between the first station and the fourth station. In other words, the load fluctuation is also the greatest between the first station and the fourth station, so that color misregistration is significantly generated.

Referring to FIG. 7A, color registration is generated in the leading edge of the first sheet. On the other hand, referring to FIG. 7C, color misregistration is generated in the opposite direction as in the first sheet in the trailing edge of the third sheet. The load torque on the drive roller shaft decreases when the developing roller 54 comes into contact with the photosensitive drum 26. The peripheral velocity of the intermediate transfer belt 30 is thus greater when the black toner image is primarily transferred as compared to when the yellow toner image is primarily transferred, so that color misregistration is generated in the leading edge of the first sheet as illustrated in FIG. 7A. Further, the load torque on the drive roller shaft increases when the developing roller 54 separates from the photosensitive drum 26. The peripheral velocity of the intermediate transfer belt 30 is thus less when the black toner image is primarily transferred as compared to when the yellow toner image is primarily transferred. As a result, color misregistration is generated in the trailing edge of the third sheet as illustrated in FIG. 7C.

Referring to FIG. 7B, color misregistration is hardly generated on the second sheet when there is no fluctuation in the load torque in performing the primary transfer. Further, color misregistration of the magenta image and the cyan image with respect to the black image are generated in the leading edge of the first sheet and the trailing end of the third sheet (not illustrated). However, such misregistration is not as significant as the misregistration between the yellow toner image and the black toner image.

The above-described color misregistration is not generated when there is no peripheral velocity difference between the photosensitive drum 26 and the intermediate transfer belt 30. The present exemplary embodiment thus describes a method for correcting the velocity of the photosensitive drum 26 to reduce color misregistration.

As described above, the size of misregistration changes according to the usage of the intermediate transfer belt 30 even when the peripheral velocity difference between the photosensitive drum 26 and the intermediate transfer belt 30 is the same (refer to FIG. 6). Therefore, as illustrated in FIG.

8, a photosensitive drum velocity V(n) at which color misregistration becomes zero cannot be acquired by only acquiring one point, i.e., X1(V(1), R(1)), which indicates a relation between the photosensitive drum velocity V(n) and the color misregistration R(n). Therefore, according to the present exemplary embodiment, X2(V(2), R(2)) is acquired, and the photosensitive drum velocity V(n) at which color the misregistration becomes zero is then acquired from the two points, i.e., X1(V(1), R(1)) and X2(V(2), R(2)).

Figure 3B:
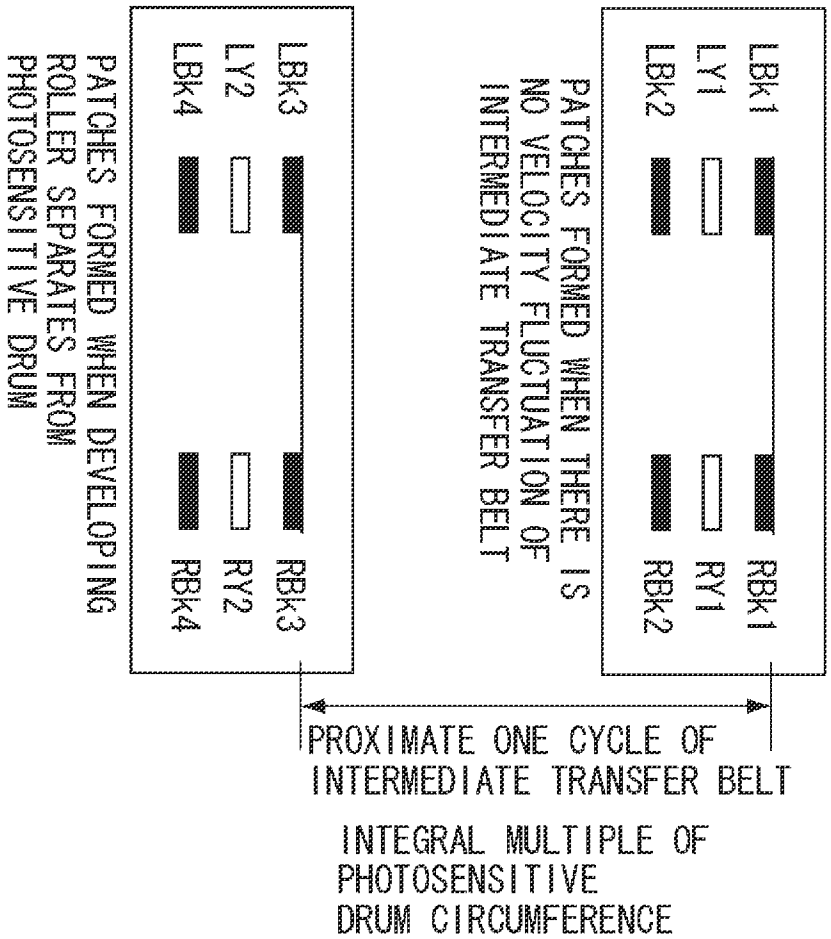
Figure 9:
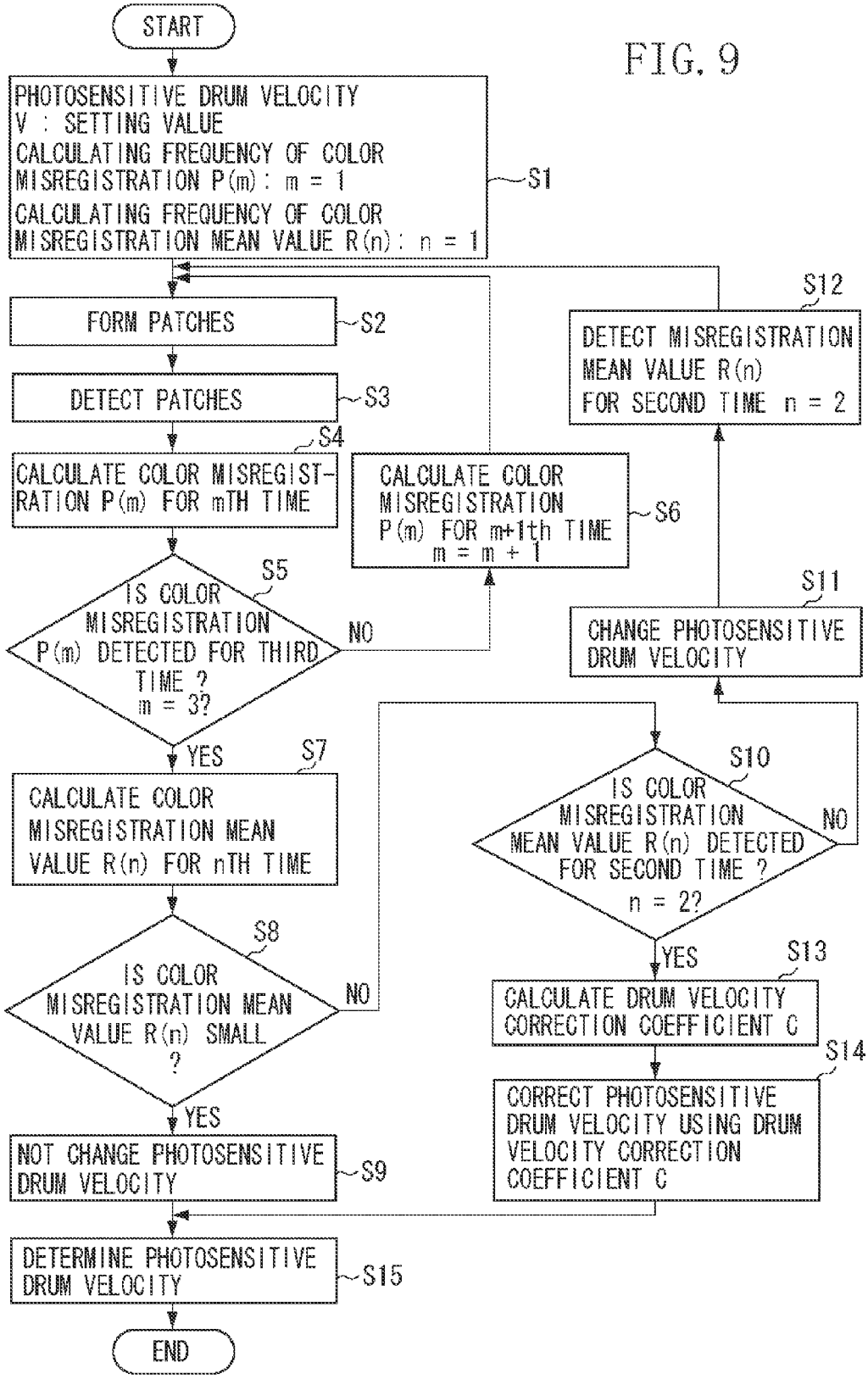
FIG. 9 is a flowchart illustrating a process for correcting the photosensitive drum velocity.
Figure 10:
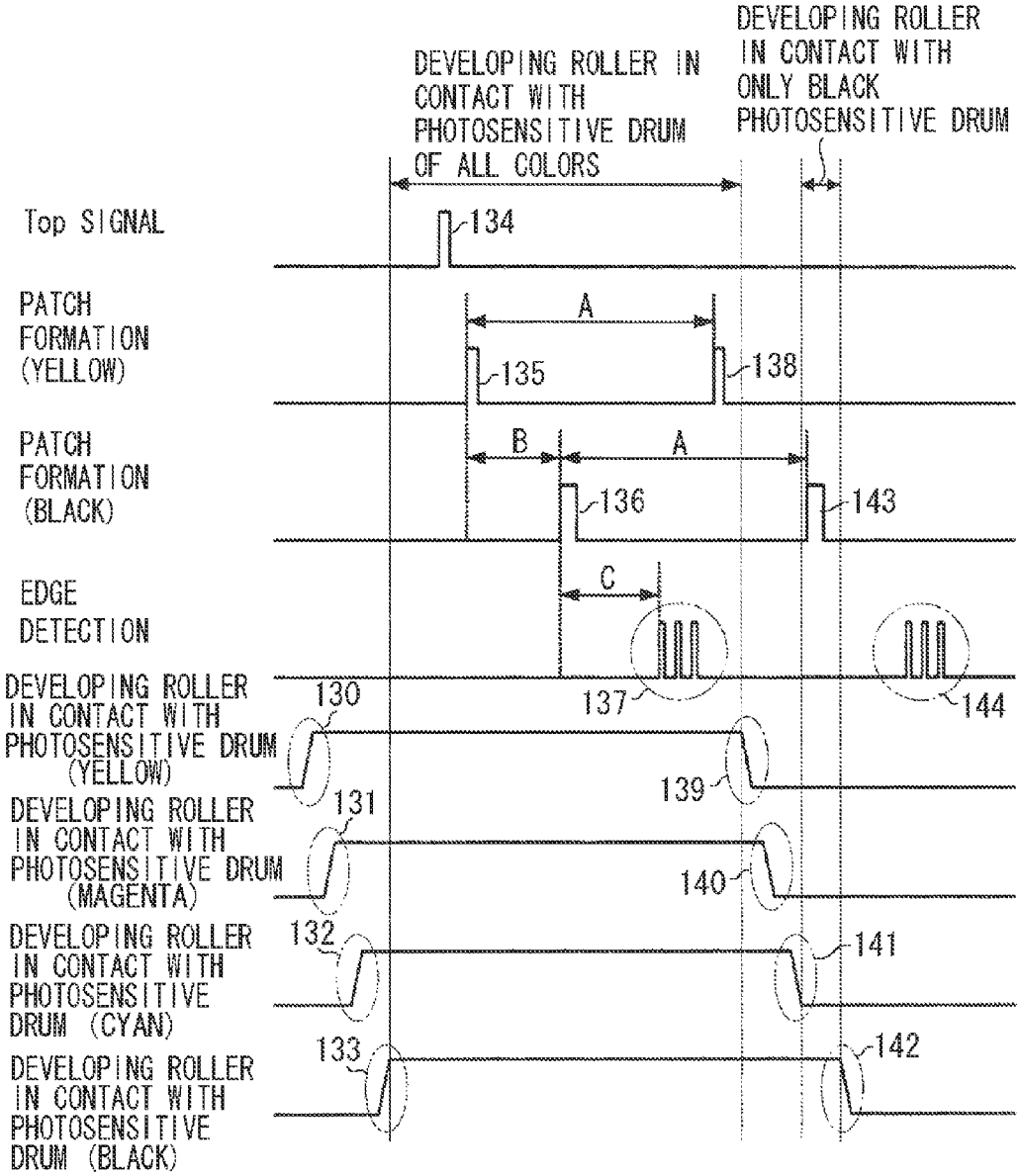
FIG. 10 illustrates a timing chart of correcting the photosensitive drum velocity.

A method for correcting the velocity of the photosensitive drum 26 will be described below with reference to FIGS. 3B, 9, and 10. FIG. 3B illustrates the color misregistration detection patterns. FIG. 9 illustrates a flowchart of a photosensitive drum velocity correction sequence. FIG. 10 illustrates a timing chart for performing color misregistration detection.

Referring to FIG. 9, in step S1, the image forming control unit 12 drives the photosensitive drum 26 at a setting value V.

In step S2, the image forming unit 13 forms patches for detecting the amount of color registration generated by the velocity fluctuation of the intermediate transfer belt 30. In step S3, the registration detection sensor unit 15 detects the patches. When forming the patches in step S2, the image forming unit 13 forms the color registration pattern as illustrated in FIG. 3B in response to an instruction from the image forming control unit 12.

FIG. 10 illustrates a timing chart for performing the patch formation (S2) and the patch detection (S3). Each of the operations performed by the image forming apparatus is indicated on a vertical axis, and time is indicated on a horizontal axis. The timing chart illustrated in FIG. 10 will be described in detail below.

Referring to FIG. 10, at timing 130, timing 131, timing 132, and timing 133, the image forming control unit 12 sequentially causes the developing roller 54 of each color to come into contact with the photo sensitive drum 26, starting with the yellow developing roller 54Y located upstream. The image forming operation is thus started. After the black developing roller 54Bk comes into contact with the photosensitive drum 26Bk at timing 133, the image forming control unit 12 outputs a Top signal to perform patch formation at timing 134. The Top signal is output after a predetermined time has elapsed from timing 133 and after the velocity fluctuation of the intermediate transfer belt 30 becomes small.

At timing 135, the image forming unit 13 forms on the intermediate transfer belt 30 yellow toner patches as illustrated in FIG. 3B. More specifically, the image forming unit 13 forms LY1 in the left side on the intermediate transfer belt 30 and RY1 in the right side on the intermediate transfer belt 30. At timing 136, the image forming unit 13 forms black (i.e., a second color) toner patches LBk1 and LBk2, and RBk1 and RBk2 at equal intervals in front and in back of LY1 and RY1. Such patches to be used in detecting misregistration are formed in a stable state when the toner has entered the primary transfer nips of all colors, and when there is no velocity fluctuation of the intermediate transfer belt 30. Further, since the primary transfer positions are different for the yellow toner image and the black toner image, the timing of forming the black patches is delayed from the timing of forming the yellow patches. An arrow B illustrated in FIG. 10 indicates such a delay in time.

According to the present exemplary embodiment, the colors are distinguished by referring to the toner color whose primary transfer position is located most upstream as a first color, and the toner color whose primary transfer position is located most downstream as a second color. The first color is yellow and the second color is black according to the present exemplary embodiment. However, the colors are not limited to the above and depend on the arrangement of the photosensitive drums.

Further, as illustrated in FIG. 3B, three patches (marks), such as LBk1, LY1, and LBk2, form one pattern. More specifically, a plurality of patterns which are each a set of three patches is formed, and such patterns are referred to as a first pattern, a second pattern, and a third pattern in a case where it is necessary to distinguish the patterns.

The formed black patches LBK1 and RBk1 then reach the detection position of the registration detection sensor 90 (as indicated by an arrow C illustrated in FIG. 10). At timing 137, the registration detection sensor 90 detects a total of 6 rising and negative-going edges of the formed patches. The registration detection sensor 90 detects the midpoint of the detected rising edge and the down-going edge corresponding to each patch as the position of the patch. The detection process will be described in detail below with reference to FIG. 3C.

The intermediate transfer belt 30 is then rotated, and the intermediate transfer member cleaner 32 cleans the previously formed yellow and black patches LY1, RY1, LBk1, LBk2, RBk1, and RBk2. At timing 138, the image forming unit 13 forms yellow patches LY2 and RY2 (i.e., the first color mark) at a position which is an integral multiple of the circumference of the photosensitive drum 26 from the position of the yellow patches LY1 and RY1 and at a proximate same region (position) after the intermediate transfer belt 30 is once rotated. An arrow A illustrated in FIG. 10 indicates a length of approximately one rotation of the intermediate transfer belt 30. A stable state is also reached at timing 138, in which the toner has entered the primary transfer nip of all colors, and there is no velocity fluctuation of the intermediate transfer belt 30.

At timing 139, timing 140, timing 141, and timing 142, the image forming control unit 12 sequentially separates the yellow, magenta, and cyan developing rollers 54Y, 54M, and 54C from the respective photosensitive drums 26Y, 26M, and 26C after primarily transferring the yellow patches LY2 and RY2. The image forming operations for yellow, magenta, and cyan toner images thus end.

At timing 143, the image forming unit 13 then forms on the intermediate transfer belt 30 black toner patches LBk3, and LBk4, and RBk3 and Rbk4 at equal intervals in front and back of LY2 and RY2 respectively. The misregistration detection pattern (or the color misregistration detection pattern) is thus formed by performing the toner patch formation at timing 143 and timing 138. Further, the processes performed at timing 138 and timing 143 are repeated if "NO" is determined in step S8 and step S10 illustrated in FIG. 9 as will be described below. Each of the patterns formed at timing 138 and timing 143 will be referred to as a first pattern and a second pattern respectively.

At timing 143, the toner transiently enters a portion of the primary transfer nips and does not enter the other primary transfer nips, so that velocity fluctuation is generated in the intermediate transfer belt 30. Further, at timing 143, a portion of the developing units (i.e., developing rollers) can be separated from or be in contact with the photosensitive drum 26. Furthermore, the image forming unit 13 forms the black toner patches LBk3, and LBk4, and RBk3 and Rbk4 similarly to the yellow toner patches. More specifically, the image forming unit 13 forms each of the black toner patches at a position which is located an integral multiple of the circumference of the photosensitive drum 26 from the position of the patches LBk1, LBk2, RBk1, and RBk2 and a proximate same region (position) after the intermediate transfer belt 30 is once rotated.

When the formed patches reach the detection position of the registration detection sensor 90, the registration detection sensor 90 detects the position of each patch at timing 144.

According to the present exemplary embodiment, the patches LY1 and the like are formed in the stable state and the patches LY2 and the like are formed in the fluctuating state when the developing roller 54 separates from the photosensitive drum 26. These patches are positioned apart by an integral multiple of the circumference of the photosensitive drum 26 and are at a proximate same region (position) after the intermediate transfer belt 30 is once rotated. This is to reduce the effect of an edge-runout of the photosensitive drum 26 and the non-uniformity in the film thickness of the intermediate transfer belt 30.

The edge-runout is generated due to difficulty of manufacturing the photosensitive drum 26 having a uniform circumference. Further, it is difficult to manufacture the intermediate transfer belt 30 of uniform film thickness, so that the thickness becomes different, causing difference in the conveyance velocity to be generated. To reduce the effects of the edge-runout of the photosensitive drum circumference and the unevenness in the film thickness of the intermediate transfer belt 30, the patches are thus formed at a distance which is an integral multiple of the circumference of the photosensitive drum 26. Further, the patches are formed at a proximate same region (position) after the intermediate transfer belt 30 is once rotated. A cycle of the unevenness in the film thickness is one circle of the intermediate transfer belt, and it is not necessary to keep the position of the patch to be strictly one cycle of the intermediate transfer belt 30.

As described above, the patches are formed at a position of an integral multiple of the circumference of the photosensitive drum 26 to reduce the effect of the edge-runout of the photosensitive drum 26. However, the patches can also be formed at an integral multiple of the circumference of the drive roller 100 to reduce the effect of the edge-runout of the drive roller 100 which drives the intermediate transfer belt 30. Further, the patches can be formed at a position which is a common multiple of the circumferences of the photosensitive drum 26 and the drive roller 100.

Returning to the flowchart illustrated in FIG. 9, in step S4, the image forming control unit 12 calculates the amount of color registration from the difference in the timings of detecting the patches. The color registration generated when there is no velocity fluctuation of the intermediate transfer belt 30 is indicated as S. The color misregistration generated when the developing roller 54 separates from the photosensitive drum 26 is indicated as U.

The misregistration S is calculated by calculating color misregistration in the left side on the intermediate transfer belt 30, i.e., L1, and color misregistration in the right side on the intermediate transfer belt 30, i.e., R1, using equations (7) and (8).

$$L1=LY1-(LBk1+LBk2)/2 \tag{7}$$

$$R1=RY1-(RBk1+RBk2)/2 \tag{8}$$

A mean value of the left-side color misregistration L1 and the right-side color misregistration R1 is then calculated using equation (9) to calculate the color misregistration S in a stable state where no velocity fluctuation of the intermediate transfer belt 30 occurs.

$$S=(L1+R1)/2 \tag{9}$$

The color misregistration S is caused by factors other than the tangential force fluctuation generated at the primary transfer nip and corresponds to the amount of static or direct color misregistration.

Figure 3C:
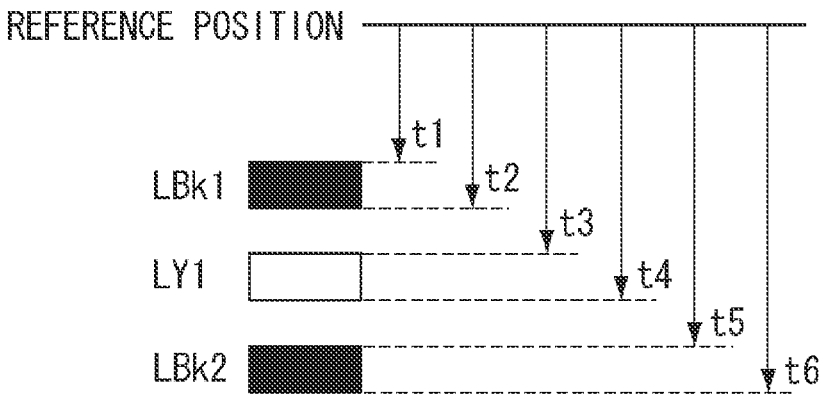

FIG. 3C illustrates the relative positions of the toner patches such as LY1, LBk1, and LBk2. Referring to FIG. 3C, t1, t2, t3, t4, t5, and t6 indicate time required for the registration detection sensor 90 to detect the edges of the patches from the reference position (reference timing), and thus indicate the position of the patches. If LBk1=(t1+t2)/2, LY1=(t3+t4)/2, and LBk2=(t5+t6)/2, then LY1−(LBk1+LBk2)/2 becomes zero or proximately zero when there is no color misregistration. On the contrary, if color misregistration is generated, LY1−(LBk1+LBk2)/2 does not become zero. Further, the same can be said for other patches such as RBk1 and RBk2, and therefore their description will be omitted.

The misregistration U generated when the developing roller 54 separates from the photosensitive drum 26 is calculated by calculating color misregistration in the left side on the intermediate transfer belt 30, i.e., L2, and color misregistration in the right side on the intermediate transfer belt 30, i.e., R2, using equations (10) and (11).

$$L2=LY2-(LBk3+LBk4)/2 \tag{10}$$

$$R2=RY2-(RBk3+RBk4)/2 \tag{11}$$

A mean value of the left-side color misregistration L2 and the right-side color misregistration R2 is then calculated using equation (12) to calculate the color misregistration U.

$$U=(L2+R2)/2 \tag{12}$$

A difference P between the above-described color misregistration S generated when the intermediate transfer belt 30 is stably moving and the color misregistration U generated when the developing roller 54 separates from the photosensitive drum 26 is then calculated using equation (13). The calculated difference P which is color registration caused by the velocity fluctuation of the intermediate transfer belt 30 is used to correct the velocity of the photosensitive drum 26.

$$P=(S-U) \tag{13}$$

According to the present exemplary embodiment, the color registration P is detected three times in step S5 illustrated in FIG. 9, to improve the detection accuracy of the color registration. In step S7, a mean value of the color registrations P is calculated as color registration R to be used in correcting the velocity of the photosensitive drum.

$$R=(P(1)+P(2)+P(3))/3 \tag{13'}$$

Figure 8:
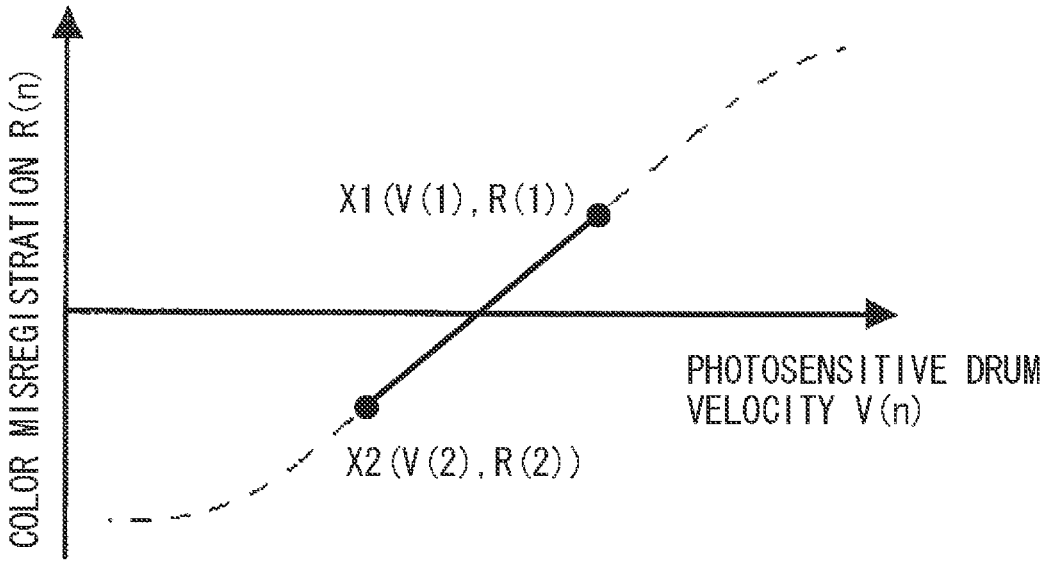
FIG. 8 illustrates an example of a relation between the photosensitive drum velocity and a color misregistration amount.

The method for correcting the velocity of the photosensitive drum using the detected color misregistration average value R(n) will be described below. In step S7, if the color registration average value detected by the above-described method is R(1) and the peripheral velocity of the photosensitive drum 26 is V (1), X1 (V(1), R(1)) illustrated in FIG. 8 can be acquired.

In step S8, if it is determined that the detected color misregistration average value R(n) is less than a predetermined value (YES in step S8), the process proceeds to step S9. In step S9, it is determined that the peripheral velocity difference between the photosensitive drum 26 and the intermediate transfer belt 30 is small. The velocity of the photosensitive drum 26 is thus not corrected, and the current velocity of the photosensitive drum 26 is employed. However, the velocity of the photosensitive drum 26 can be corrected even if the color misregistration average value R(n) is small to reduce the peripheral velocity difference.

If the detected color misregistration average value R(n) is greater than a predetermined value (NO in step S8), the process proceeds to step S11. In step S11, the velocity of the photosensitive drum 26 is changed to detect a color misregistration average value R(2) using a photosensitive drum velocity V(2) which is different from the photosensitive drum velocity V(1). If the color misregistration average value R(1) is greater than zero, the peripheral velocity of the photosensitive drum 26 is decreased by 0.1%. On the other hand, if the color misregistration average value R(1) is less than zero, the peripheral velocity of the photosensitive drum 26 is increased by 0.1%. According to the present exemplary embodiment, the photosensitive drum velocity V(2) is different from the photosensitive drum velocity V(1) by 0.1%. It is preferable to set the photosensitive drum velocity V(2) within a range in which there is a linear relation between the velocity of the photosensitive drum 26 and the color misregistration.

The color misregistration average value R(2) when the peripheral velocity of the photosensitive drum 26 is V(2) is then calculated similarly to the color misregistration average value R(1) in step S2 to step S7.

In step S13, a drum velocity correction coefficient C is calculated using equation 14 and the acquired X1 (V(1), R(1)) and X2 (V(2), R(2)). The drum velocity correction coefficient C is a parameter which indicates a velocity correction amount per unit misregistration amount. In other words, the drum velocity correction coefficient C is an amount of change in the X-axis direction when there is a unit amount of change in the Y-axis direction.

$$C=(V(1)-V(2))/(R(1)-R(2)) \tag{14}$$

In step S14, the photosensitive drum velocity V when there is no color registration, i.e., when the peripheral velocity difference between the photosensitive drum 26 and the intermediate transfer belt 30 is zero or proximately zero, is calculated using the calculated drum velocity correction coefficient C. Equation 15 is used to calculate the photosensitive drum velocity V. The velocities of one or more motors driving the photosensitive drum are thus comprehensively corrected using the velocity calculated by equation (15), and hereinafter, the image forming process is performed at the corrected photosensitive drum velocity.

$$V=V(1)-C\times R(1) \tag{15}$$

As described above, the peripheral velocity V of the photosensitive drum 26 is corrected. However, the method for correcting the peripheral velocity is not limited to the above-described method. Any method can be used as long as the relative velocity between the image bearing member (i.e., the photosensitive drum) and the intermediate transfer member (i.e., the intermediate transfer belt) is corrected to zero or proximately zero. The traveling velocity of the intermediate transfer belt can also be corrected by reflecting the difference between the velocity V acquired using equation (15) and the velocity V before correction.

In other words, color misregistration can be flexibly reduced when forming the image without shortening the life of the image forming unit by correcting the velocity of either the image bearing member (i.e., the photosensitive drum) or the intermediate transfer member (i.e., the intermediate transfer belt). The present invention can thus provide a method which takes into consideration the effect of the degree of change in the tangential force between the image bearing member (i.e., the photosensitive drum) and the intermediate transfer member (i.e., the intermediate transfer belt).

Further, in the above-described exemplary embodiment, the drum velocity correction coefficient C is calculated based on two points, i.e., X1 (V(1), R(1)) and X2 (V(2), R(2)). However, the drum velocity correction coefficient C can be calculated based on more than two points. An effect of scattering in Xn (V(n), R(n)) can be reduced by calculating the drum velocity correction coefficient C based on a plurality of points, and the accuracy of the drum velocity correction coefficient C can be improved. The photosensitive drum velocity correction sequence determines the correction amount based on the drum velocity correction coefficient C. The accuracy in correcting the velocity of the photosensitive drum 26 can thus be improved by improving the accuracy of the drum velocity correction coefficient C, so that the color misregistration can be reduced.

Figure 11:
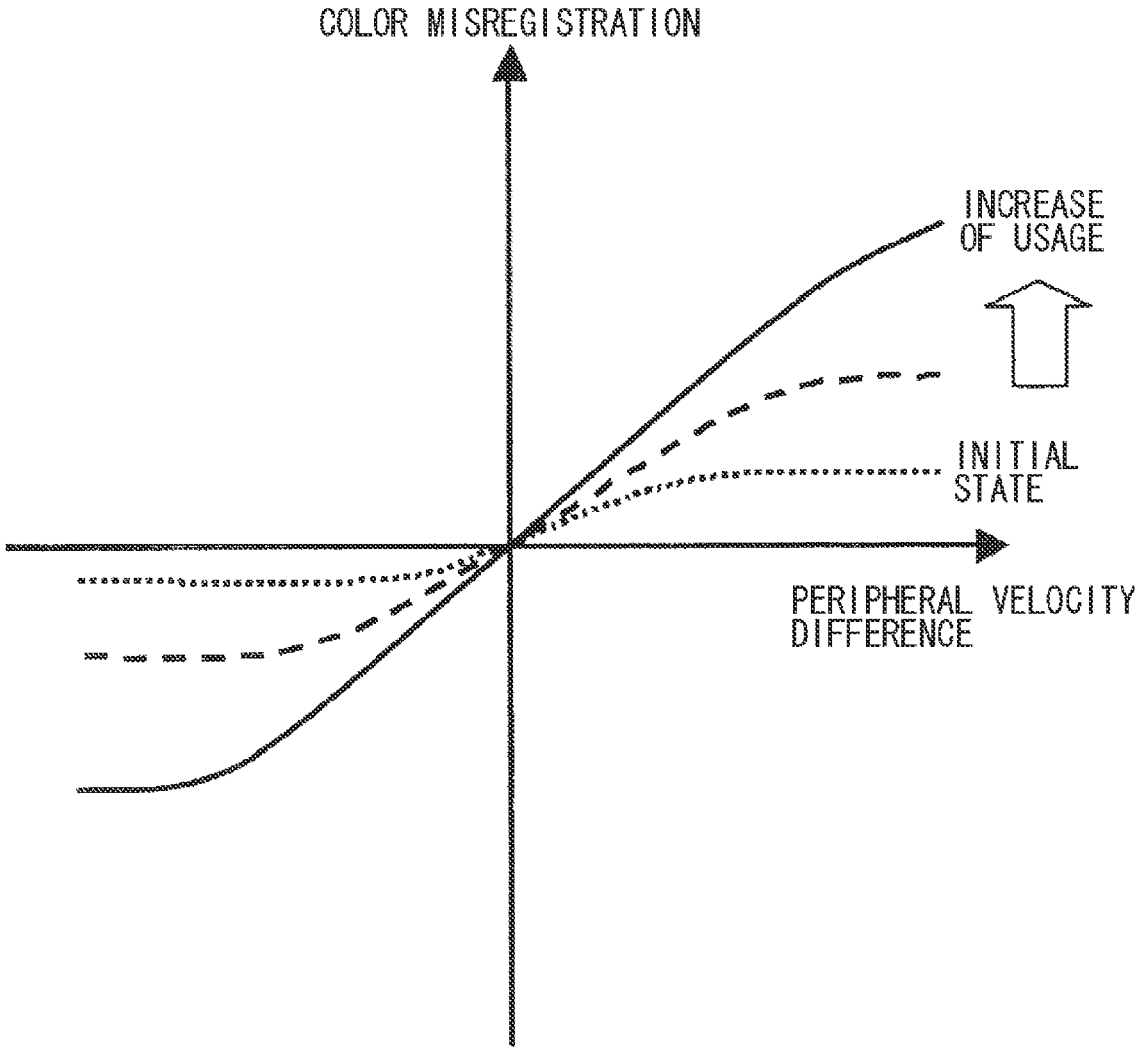
FIG. 11 illustrates an example of a relation between the peripheral velocity difference between a photosensitive drum and an intermediate transfer belt, and color misregistration generated when there is velocity fluctuation in the intermediate transfer belt.

Furthermore, as illustrated in FIG. 11, the drum velocity correction coefficient C is expressed as a gradient of the linear line by taking the color misregistration on the vertical axis and the velocity of the photosensitive drum 26 on the horizontal axis. As described above, the tangential force acting on the primary transfer nip changes according to the usage of the intermediate transfer belt 30 even when the peripheral velocity difference is the same. Color misregistration thus increases as the usage of the intermediate transfer belt 30 increases. As a result, the drum velocity correction coefficient C changes according to the usage as illustrated in FIG. 11. In the initial state, the gradient is small, and the gradient increases as the usage increases.

According to the present exemplary embodiment, the drum velocity correction coefficient is calculated when correcting the velocity of the photosensitive drum 26. The velocity of the photosensitive drum 26 can thus be corrected to reduce the color misregistration regardless of the usage of the intermediate transfer belt 30. Moreover, the velocity of the photosensitive drum 26 can be corrected even when the drum velocity correction coefficient changes due to factors other than the usage of the intermediate transfer belt 30, such as the usage environment of the apparatus.

As described above, according to the present exemplary embodiment, color registration can be reduced without immoderately shortening the life of the image forming unit and by flexibly suppressing velocity fluctuation of the intermediate transfer member generated while forming an image. In other words, the present invention can provide a method which takes into consideration the effect of the degree of change in the tangential force between the image bearing member (i.e., the photosensitive drum) and the intermediate transfer member (i.e., the intermediate transfer belt).

If the circumference of the drive roller 100 which determines the conveyance velocity of the intermediate transfer belt 30 is a designed central value, the peripheral velocity difference of the photosensitive drum 26 and the intermediate transfer belt 30 can be previously set to be zero or proximately zero. However, since there is dispersion in the circumference of the drive roller 100 within the range of tolerance, the velocity of the intermediate transfer belt 30 changes by an amount of the difference from the designed central value. Therefore, the peripheral velocity difference is generated between the photosensitive drum 26 and the intermediate transfer belt 30 and causes color misregistration.

To address this problem, the sequence illustrated in FIG. 10 is performed when the image forming apparatus is initially activated. As a result, the velocities of the photosensitive drum and the intermediate transfer belt can be matched even when the circumferences of the photosensitive drum and the driving roller are different from the designed central values. The generation of the color misregistration can thus be reduced. Further, color misregistration can be reduced by performing the sequence illustrated in FIG. 10 when changing the process cartridge or the intermediate transfer belt unit 31.

A second exemplary embodiment of the present invention will be described below. According to the first exemplary embodiment, patch formation at timing 135 and timing 136, and patch detection at timing 137 are repeatedly performed. However, the present invention is not limited to such a method.

According to the present exemplary embodiment, patch formation at timing 135 and timing 136, and patch detection at timing 137 can be omitted when performing step S2 to step S7 either for the first time or for the second time. The value of S=(L1+R1)/2 acquired by performing step S2 to step S7 either for the first time or the second time can be used instead. More specifically, the pattern including the patches formed at timing 135 and timing 136 illustrated in FIG. 10 may be formed to correspond to at least one of the patterns formed by performing the processes at timing 138 and timing 143 for the first time and for the second time.

The image forming control unit 12 can acquire the color misregistration amount for each relative velocity similarly to the first exemplary embodiment by using the detection result of the patches formed at timing 135 and timing 136 as described above.

The image forming control unit 12 can calculate the direct color misregistration amount which is not caused by the tangential force fluctuation generated at the first transfer nip, by using the detection result of the patterns formed at timing 135 and timing 136.

Further, the image forming control unit 12 subtracts (deletes) the calculated direct color misregistration amount from the detection result of the pattern formed in performing the processes at timing 138 and timing 143 for the first time and the second time illustrated in FIG. 10. As a result, the color misregistration amount caused by the tangential force fluctuation generated at the first transfer nip for each relative velocity can be extracted. After extracting the color misregistration amount, the peripheral velocity difference (relative velocity) between the photosensitive drum 26 and the intermediate transfer belt 30 is corrected based on the extracted result, similarly to the first exemplary embodiment. The detailed processes to follow are similar to the first exemplary embodiment, and description will be omitted.

A third exemplary embodiment according to the present invention will be described below. According to the first exemplary embodiment, the color misregistration S is calculated when there is no change in the tangential force, i.e., when the intermediate transfer belt 30 is rotating in a stable state. However, the position for forming the pattern may be corrected before performing the color misregistration detection sequence illustrated in FIG. 9 so that the color misregistration becomes zero. The calculation of the color misregistration S can then be omitted.

In such a case, the process illustrated by the flowchart of FIG. 9 can be performed by omitting the processes performed at timing 135, timing 136, and timing 137 illustrated in FIG. 10, and the calculations using equations (9) and (13). The time necessary to perform the toner patch formation and the detection can then be reduced by previously correcting the color misregistration and executing the modified process of the flowchart illustrated in FIG. 9. The color misregistration correction to be previously performed uses a known technique. More specifically, the toner patches to be used in correcting the color misregistration for four colors are formed, and the position of an adjusting color (e.g., colors other than yellow) with respect to a reference color (e.g., yellow) is corrected. A detailed description will thus be omitted.

Further, the processes performed at timing 135, timing 136, and timing 137 can also be omitted if the process illustrated in the flowchart illustrated in FIG. 9 according to the first exemplary embodiment is performed when there is no color misregistration (i.e., S calculated using the above-described equation (9) is zero).

As described above, the present exemplary embodiment at least forms both the yellow toner patch in the stable state in which the toner enters all primary transfer nips (at timing 138) and the black toner patch in the fluctuating state in which the toner enter a portion of the primary transfer nips (at timing 143). The patch formation performed at timing 135 and timing 136 illustrated in FIG. 10 simplifies the color misregistration correction which previously sets the color misregistration S to zero and also improves user-friendliness.

A fourth exemplary embodiment will be described below. The first, second, and third exemplary embodiments are directed to a method for detecting color misregistration generated when the developing roller 54 separates from the photosensitive drum 26. The color misregistration P can also be calculated by detecting the color misregistration generated when the developing roller 54 comes into contact with the photosensitive drum 26.

More specifically, at timing 130 illustrated in FIG. 10, only the yellow developing roller 54Y in the developing unit 51Y comes into contact with the photosensitive drum 26Y. At timing 135, yellow patch formation is then performed in the fluctuating state when the velocity fluctuation is generated in the intermediate transfer belt. Further, at timing 136, black patch formation is performed in the stable state in which all developing units 51 are in contact with the respective photosensitive drums 26.

Furthermore, the patch formation at timing 138 and timing 143 are performed in the stable state in which all developing units 51 are in contact with the respective photosensitive drums 26. The process illustrated in the flowchart of FIG. 9 is then performed according to the above-described changes in the processes illustrated in FIG. 10. In such a case, the patch formation performed at timing 138 and timing 143 can be omitted, or one of the two series of processes performed at timing 138, timing 143, and timing 144 can be omitted similarly to the first, second and third exemplary embodiments.

As described above, color misregistration can be reduced without immoderately shortening the life of the image forming unit when the developing unit 51 starts to come into contact with the photosensitive drum in addition to when separating from the photosensitive drum. For example, the color misregistration can also be reduced when primary transfer of a first page of a print job is started. In other words, the present invention can provide a method which takes into consideration the effect of the degree of change in the tangential force between the image bearing member (i.e., the photosensitive drum) and the intermediate transfer member (i.e., the intermediate transfer belt).

A modified example according to the present invention will be described below. In the above-described photosensitive drum velocity correction sequence, the velocity of the photosensitive drum 26 is corrected so that the color misregistration becomes zero, i.e., the peripheral velocity difference between the photosensitive drum 26 and the intermediate transfer belt 30 becomes zero or proximately zero. However, since the peripheral velocity difference between the photosensitive drum 26 and the intermediate transfer belt 30 affects also transfer efficiency, a predetermined peripheral velocity difference may become necessary between the photosensitive drum 26 and the intermediate transfer belt 30. More specifically, the toner on the photosensitive drum 26 can be more easily scraped off when there is a predetermined peripheral velocity difference, and the transfer efficiency is thus improved.

Since the relation between the peripheral velocity difference and the color misregistration can be acquired by calculating the drum velocity correction coefficient C, an arbitrary peripheral velocity difference can be set. Therefore, a relation between the velocities of the photosensitive drum 26 and the intermediate transfer belt 30 which takes into account the color misregistration and the transfer efficiency can be set by performing the photosensitive drum velocity correction sequence.

Further, the velocity of the intermediate transfer belt 30 can be corrected using a method similar to correcting the velocity of the photosensitive drum 26.

Furthermore, the velocities of the photosensitive drum 26 and the intermediate transfer belt 30 may become different from the designed central values by a change in the environmental temperature, or the temperature inside the apparatus when papers are continuously passed through the apparatus. In such a case, a temperature detection unit is disposed inside the apparatus main body or near the photosensitive drum or the driving roller. When a predetermined temperature rise is detected, the photosensitive drum velocity correction sequence is performed to prevent color misregistration. Similarly, the velocity fluctuation due to the usage of the intermediate transfer belt 30 can be corrected based on a pixel count or a history of the number of passing sheets.

Moreover, the velocities of the photosensitive belt and an intermediate transfer drum employed as the image bearing member in an image forming apparatus can be corrected by a similar velocity correction sequence.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-054858 filed Mar. 9, 2009, which is hereby incorporated by reference herein in its entirety.

What is claimed is:

1. An image forming apparatus including an image forming unit comprising a plurality of image bearing members, a plurality of developing units capable of coming into contact with and separating from each of the plurality of image bearing members, an intermediate transfer member onto which toner images developed on the plurality of image bearing members by the plurality of developing units are transferred, and a plurality of transfer members which forms a plurality of nip portions with the plurality of image bearing members by sandwiching the intermediate transfer member, the image forming apparatus comprising:

a pattern forming unit configured to form on the intermediate transfer member by employing the image forming unit a pattern for detecting positional deviation including a first color mark formed in which toner enters all of the nip portions of the plurality of image bearing members, and a second color mark formed in which toner enters a part of the nip portions of the plurality of image bearing members;

a detection unit configured to detect positions of the first color mark and the second color mark included in the pattern for detecting positional deviation; and a correction unit configured to correct a relative velocity between the image bearing member and the intermediate transfer member based on a detection result of the detection unit, wherein a first relative velocity and a second relative velocity different from the first relative velocity can be set between the image bearing member and the intermediate transfer member, wherein the pattern forming unit forms the pattern at the first relative velocity and the second relative velocity, and wherein the correction unit corrects the relative velocity based on the pattern formed at the first relative velocity and the pattern formed at the second relative velocity, detected by the detection unit.

2. An image forming apparatus including an image forming unit comprising a plurality of image bearing members, a plurality of developing units capable of coming into contact with and separating from each of the plurality of image bearing members, an intermediate transfer member onto which toner images developed on the plurality of image bearing members by the plurality of developing units are transferred, and a transfer member which forms a nip portion with the image bearing member by sandwiching the intermediate transfer member, the image forming apparatus comprising:

a pattern forming unit configured to form on the intermediate transfer member by employing the image forming unit a pattern for detecting positional deviation including a first color mark formed in a state in which all of the plurality of developing units are in contact with the plurality of image bearing members, and a second color mark formed in a state in which a part of the plurality of developing units is separated from or is in contact with the plurality of image bearing members;

a detection unit configured to detect positions of the first color mark and the second color mark included in the pattern for detecting positional deviation; and a correction unit configured to correct a relative velocity between the image bearing member and the intermediate transfer member based on a detection result of the detection unit, wherein a first relative velocity and a second relative velocity different from the first relative velocity can be set between the image bearing member and the intermediate transfer member, wherein the pattern forming unit forms the pattern at the first relative velocity and the second relative velocity, and wherein the correction unit corrects the relative velocity between the image bearing member and the intermediate transfer member based on the pattern formed at the first relative velocity, and the pattern formed at the second relative velocity, detected by the detection unit.

3. The image forming apparatus according to claim 1, wherein the detection unit detects a first positional deviation amount based on a position of the first color mark and a position of the second color mark included in the pattern formed at the first relative velocity, and a second positional deviation amount based on a position of the first color mark and a position of the second color mark included in the pattern formed at the second relative velocity, and wherein the correction unit corrects the relative velocity between the image bearing member and the intermediate transfer member based on the first positional deviation amount and the second positional deviation amount.

4. The image forming apparatus according to claim 1, wherein the pattern forming unit causes the image forming unit to form the first color mark in a state in which the toner enters all of the nip portions by the movement that the developing unit comes in contact with all of the plurality of the image bearing members, and the pattern forming unit causes the image forming unit to form the second color mark in a state in which the toner enters one of the nip portions by the movement that the developing unit of one of the plurality of image bearing members is separated or comes in contact.

5. The image forming apparatus according to claim 1, wherein the pattern forming unit causes the image forming unit to form a pattern at a same relative velocity, corresponding to at least one of the pattern formed at the first relative velocity and these pattern formed at the second relative velocity, which includes the first color mark and the second color mark, and at the relative velocity which is the same as that of at least one of the patterns, wherein the correction unit corrects the relative velocity based on a detection result of the pattern formed at the first relative velocity, the pattern formed at the second relative velocity, and the pattern formed at the same relative velocity.

6. The image forming apparatus according to claim 5, wherein the correction unit extracts positional deviation amount of the pattern formed at the first relative velocity and pattern formed at the second relative velocity, which is caused by velocity fluctuation of an intermediate transfer and from which a direct current positional deviation by a detection result of the pattern formed at the same relative velocity is excluded, and the correction unit corrects the relative velocity based on the extraction result.

7. The image forming apparatus according to claim 1, wherein the pattern forming unit forms the pattern formed at the first relative velocity and the pattern formed at the second relative velocity on a same region in the intermediate transfer member in the image forming unit.

8. The image forming apparatus according to claim 1, wherein the correction unit corrects a velocity of either the image bearing member or the intermediate transfer member.

* * * * *